US005462718A

United States Patent [19]

Abdulally

[11] Patent Number: 5,462,718

[45] Date of Patent: Oct. 31, 1995

[54] SYSTEM FOR DECREASING $NO_x$ EMISSIONS FROM A FLUIDIZED BED REACTOR

[75] Inventor: Igbal F. Abdulally, Randolph, N.J.

[73] Assignee: Foster Wheeler Energy Corporation, Clinton, N.J.

[21] Appl. No.: 259,083

[22] Filed: Jun. 13, 1994

[51] Int. Cl.[6] ..... B01J 8/02

[52] U.S. Cl. ..... 422/171; 422/169; 422/170; 422/173; 422/198; 423/235; 423/239.1; 122/4 D; 110/235; 110/245; 110/215

[58] Field of Search ..... 422/168–173, 422/198; 423/235, 239, 210; 122/4 D; 110/215, 245, 345

[56] References Cited

U.S. PATENT DOCUMENTS

| | | | |
|---|---|---|---|
| 3,929,967 | 12/1975 | Cann | 423/242 |
| 4,154,803 | 5/1979 | Uchikawa et al. | 423/239 |
| 4,181,705 | 1/1980 | Gumerman | 423/235 |
| 4,208,386 | 6/1980 | Arand et al. | 423/235 |
| 4,335,084 | 6/1982 | Brogan | 423/235 |
| 4,393,031 | 7/1983 | Henke | 423/239 |
| 4,519,990 | 5/1985 | Bevilaqua et al. | 423/210 |
| 4,522,154 | 6/1985 | Taylor et al. | 122/4 D |
| 4,719,092 | 1/1988 | Bowers | 423/235 |
| 4,751,065 | 6/1988 | Bowers | 423/235 |
| 4,756,890 | 7/1988 | Tang et al. | 423/235 |
| 4,777,024 | 10/1988 | Epperly et al. | 423/235 |
| 4,780,289 | 10/1988 | Epperly et al. | 423/235 |
| 4,783,325 | 11/1988 | Jones | 423/235 |
| 4,803,059 | 2/1989 | Sullivan et al. | 423/235 |
| 4,822,577 | 4/1989 | Epperly et al. | 423/243 |
| 4,830,839 | 5/1989 | Epperly et al. | 423/235 |
| 4,842,834 | 6/1989 | Burton | 423/235 |
| 4,843,981 | 7/1989 | Goldbach et al. | 110/245 |
| 4,844,878 | 7/1989 | Epperly et al. | 423/235 |
| 4,863,704 | 9/1989 | Epperly et al. | 423/235 |
| 4,863,705 | 9/1989 | Epperly et al. | 423/235 |
| 4,873,066 | 10/1989 | Epperly et al. | 423/235 |
| 4,915,036 | 4/1990 | DeVita | 110/215 |
| 4,925,633 | 5/1990 | Doyle | 422/171 |
| 5,176,088 | 1/1993 | Amrhein et al. | 422/172 |
| 5,233,934 | 8/1993 | Krigmont et al. | 422/171 |

FOREIGN PATENT DOCUMENTS

| | | |
|---|---|---|
| 0176293 | 4/1986 | European Pat. Off. . |

OTHER PUBLICATIONS

T. C. Hess, Advanced $NO_x$ and $SO_2$ emisson control performance on a CFB, Power Engineering, Jul. 1989.

*Primary Examiner*—Robert J. Warden
*Assistant Examiner*—Hien Tran
*Attorney, Agent, or Firm*—Marvin A. Naigur

[57] ABSTRACT

A system and method are disclosed for lowering $NO_x$ levels in flue gases of a fluidized bed reactor using selective non-catalytic reduction. A reactor is connected to a separator by a duct, and a reactant is introduced into the duct for decreasing $NO_x$ levels in the flue gases passing from the reactor, through the duct, and into the separator. The reactant, such as ammonia or urea, is selectively injected into a gaseous-rich region of the duct, near an upper, inner portion of the duct, so that a high degree of mixing of the reactant with flue gases is achieved while maintaining a low degree of mixing of the reactant with the particulate materials. The point of injection of the reactant into the duct is also at a location nearer to the reactor than to the separator to provide for increased residence time. In this manner, the reactant is used efficiently while obtaining the desired lowering of $NO_x$ levels in the flue gases.

11 Claims, 1 Drawing Sheet

SYSTEM FOR DECREASING $NO_X$ EMISSIONS FROM A FLUIDIZED BED REACTOR

BACKGROUND OF THE INVENTION

This invention relates to a system and method of decreasing nitrogen oxides ("$NO_x$") emissions from a fluidized bed reactor. More particularly, this invention relates to the selective injection of a reactant into the reactor for reducing $NO_x$ levels in gaseous products of combustion in the reactor.

Fluidized bed combustion systems are well known and include a furnace section in which an oxygen-containing gas such as air is passed through a bed of particulate materials, including nitrogen-containing, carbonaceous fuel material, such as coal. Sorbent particles, such as limestone, lime, or dolomite may be added for the capture of oxides of sulfur generated during combustion. The oxygen-containing gas fluidizes the particulate materials in the furnace section and promotes the combustion of the particulate fuel material at a relatively low temperature. These types of combustion systems are often used in steam generators in which a cooling fluid, such as water, is passed through a fluid flow circuit in a heat exchange relationship to the fluidized bed reactor to generate steam and to permit high combustion efficiency, fuel flexibility, high sulfur adsorbtion, and relatively low $NO_x$ emissions.

A typical fluidized bed reactor utilized in the generation of steam is commonly referred to as a "bubbling" fluidized bed in which the fluidized particulate materials form a bed having a relatively high density and a well-defined or discrete upper surface. A more commonly used fluidized bed reactor is referred to as a "circulating" fluidized bed in which the fluidized particulate materials form a lower dense bed having a density below that of a typical bubbling fluidized bed and in which the primary gas has a fluidizing velocity which is equal to or greater than that of a bubbling bed. The primary gas passing through the lower dense bed entrains a substantial amount of fine particulate materials to form an upper dispersed bed of particulate materials, often to the extent that the primary gas is substantially saturated with the particulate materials in the dispersed bed.

It is generally considered desirable to operate these circulating fluidized beds using relatively high internal and external solids recycling so that they are insensitive to fuel heat release patterns, thus minimizing temperature variations and stabilizing the sulfur emissions at a low level. The high external solids recycling is achieved by disposing a separator, such as a cyclone separator, at the furnace section outlet to receive the flue gases, and the particulate materials entrained thereby, from the dispersed bed of the furnace section. The entrained particulate materials are separated from the flue gases in the separator, and the cleaned flue gases are passed to a heat recovery section while the separated particulate materials are recycled back to the furnace section. This recycling improves the efficiency of the separator, and the increased residence times of the fuel and sorbent particles result in more efficient use of the fuel and sorbent particles and, therefore, reduced consumption of the same.

Bubbling and circulating fluidized bed reactors also offer advantages in pollution control. For example, the emissions of $NO_x$ from fluidized bed reactors are relatively low compared to emissions from other conventional systems such as gas-fired systems and coal-fired power plants. To obtain even lower $NO_x$ emission levels, selective non-catalytic reduction ("SNCR") methods and selective catalytic reduction methods ("SCR") are employed. In SNCR methods, a reactant such as urea or ammonia, is injected into the reactor to react with the $NO_x$, forming $N_2$ and $H_2O$. The reactant is typically injected through numerous ports at various locations across the reactor including the furnace section, the separator, and the duct connecting the furnace section and separator. SNCR methods thereby allow even lower $NO_x$ emission levels to be obtained.

However, SNCR methods are not without problems. For example, inefficient utilization of the added reactant often prevents the SNCR methods from obtaining the desired degree of decrease in $NO_x$ levels. For more efficient usage of the reactant, it is desirable to have a high residence time of the reactant in the system, a high degree of mixing of the reactant with the $NO_x$-containing flue gases, and a low degree of mixing of the reactant with the particulate materials circulating in the system. Present systems often suffer from inefficient use of the reactant. For example, systems which inject the reactant into the furnace section and systems which inject the reactant into various locations across the duct may suffer from too much mixing of the reactant with the particulate materials and insufficient mixing of the reactant with the $NO_x$-containing flue gases. Similarly, systems which inject the reactant into the separator may suffer from insufficient residence time and from insufficient mixing of the reactant with the $NO_x$-containing flue gases.

Inefficient utilization of the reactant results in excessive use of the reactant which adds to the cost of the SNCR method. Additionally, adding excessive amounts of reactant can generate new pollution problems.

SUMMARY OF THE INVENTION

It is therefore an object of the present invention to provide a system and method of operating a fluidized bed reactor in which $NO_x$ emission levels are lowered.

It is a further object of the present invention to provide a system and method of operating a fluidized bed reactor in which $NO_x$ emission levels are lowered using a selective non-catalytic reduction method.

It is a still further object of the present invention to provide such a system and method in which a reactant is efficiently used to decrease $NO_x$ emission levels in gaseous products of combustion.

It is a still further object of the present invention to provide a system and method of the above type which permits increased residence time of the reactant, increased mixing of the reactant with gaseous products of combustion, and decreased mixing of the reactant with particulate materials to provide for highly efficient use of the reactant.

It is a still further object of the present invention to provide a system and method of the above type in which a reactant is selectively injected into the system at a particular location for efficiently decreasing $NO_x$ emission levels in gaseous products of combustion.

Toward the fulfillment of these and other objectives, the system and method of the present invention permits the lowering of $NO_x$ levels in flue gases from a fluidized bed reactor through selective non-catalytic reduction. A reactor is connected to a separator by a duct, and a reactant is introduced into the duct for decreasing $NO_x$ levels in the flue gases passing from the reactor, through the duct, and into the separator. The reactant, such as ammonia or urea, is injected into a gaseous-rich region of the duct, near an upper, inner portion of the duct, so that a high degree of mixing of the reactant with flue gases is achieved while maintaining a low degree of mixing of the reactant with the particulate materials. The reactant is also injected into the duct at a point nearer to the reactor than to the separator to provide for increased residence time. In this manner, the reactant is used efficiently while obtaining the desired lowering of $NO_x$ levels in the flue gases.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
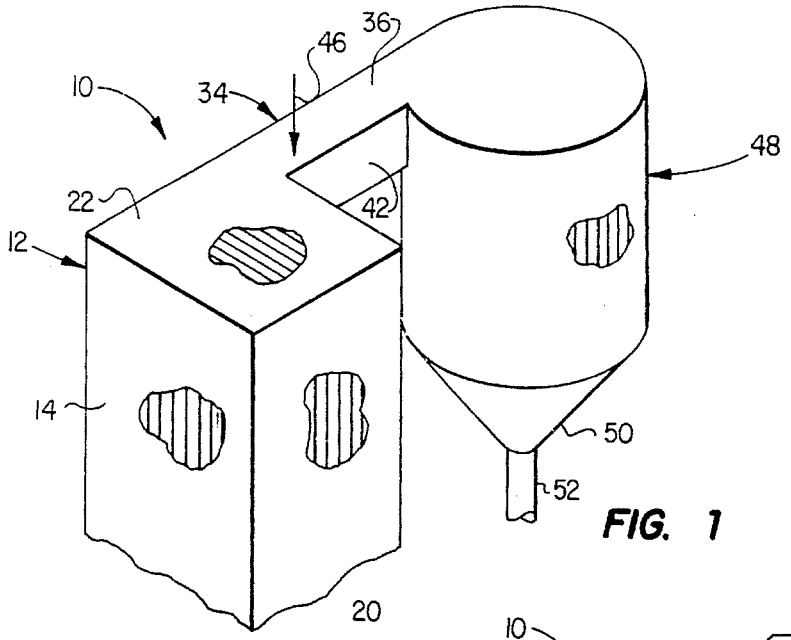
FIG. 1 is a schematic, elevational view of a portion of a fluidized bed combustion system for practicing the present invention.
Figure 2:
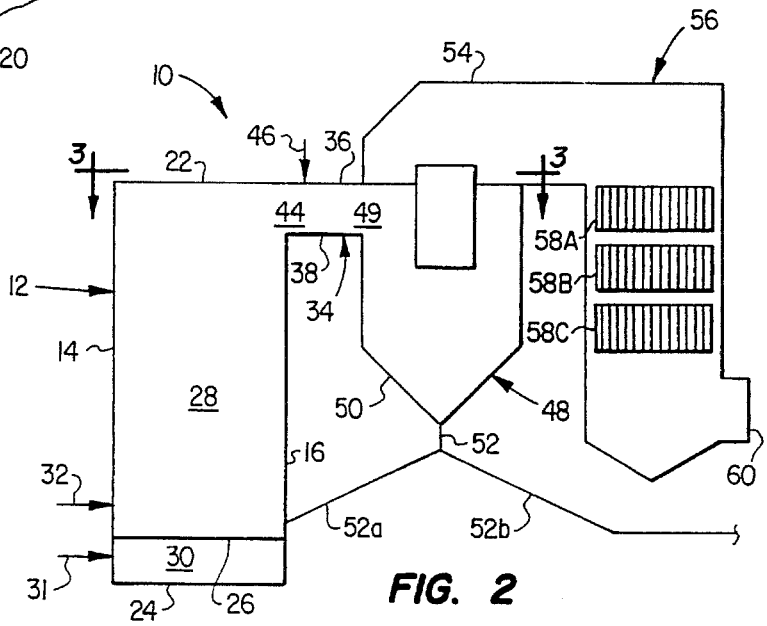
FIG. 2 is a schematic, side elevational view of a fluidized bed combustion system for practicing the present invention.
Figure 3:
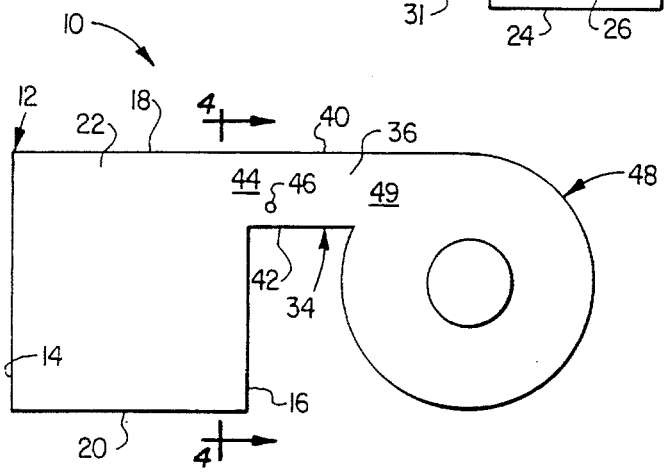
FIG. 3 is an enlarged, schematic, plan view taken along the line 3—3 of FIG. 2.
Figure 4:
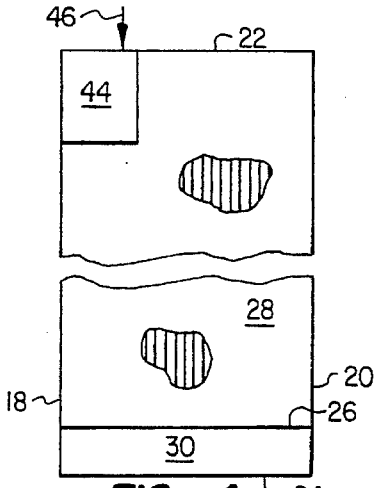
FIG. 4 is an elevational view of the system of FIGS. 2 and 3, taken along the line 4—4 of FIG. 3.

Referring to FIGS. 1–3, the reference numeral 10 refers in general to a fluidized bed reactor used for the generation of steam. The reactor 10 includes an enclosure 12 having a front wall 14, a spaced, parallel rear wall 16, two spaced side walls 18 and 20 (FIG. 3) which extend perpendicular to the front and rear walls, a roof 22, and a floor 24, which together form a substantially rectangular enclosure.

A lower portion of the enclosure 12 is divided by a perforated distribution plate 26 into a furnace section 28 and a plenum chamber 30. The distribution plate 26 is suitably supported at the lower portion of the enclosure 12 and supports a bed of particulate materials which may include nitrogen-containing carbonaceous fuel particles, such as coal, for combustion; sorbent particles, typically a calcium-containing sulfur acceptor such as limestone, lime, or dolomite, for the capture of $SO_x$ released during combustion of the fuel particles; and solid products of combustion.

A conduit 31 supplies the plenum chamber 30 with a fluidizing, oxygen-containing gas such as air from a conventional, suitable source (not shown), such as a forced-draft blower or the like. The fluidizing gas introduced into the plenum chamber 30 passes in an upward direction through the distribution plate 26 to support combustion and to fluidize the particulate materials in the furnace section 28.

A conduit 32 supplies the furnace section 28 with particulate materials which may include nitrogen-containing particulate fuel material, such as coal, and sorbent particles. It is understood that more than one conduit 32 may be used and any number of arrangements for providing fuel and sorbent particles to the furnace section 28 of the enclosure 12 may be used. Examples of a few arrangements that may be used are disclosed in U.S. Pat. No. 4,936,770, assigned to the assignee of the present invention, the disclosure of which is hereby incorporated by reference.

A burner 33 is connected to the rear wall 16 of the enclosure 12. A duct 34 is connected to the rear wall 16 of the enclosure 12 near the roof 22 and side wall 18. As best shown in FIGS. 2 and 3, the duct has a roof or top wall 36, a floor or bottom wall 38, an outer wall 40 and an inner wall 42. The duct 34 is disposed so that the outer wall 40 is aligned with and falls in the same vertical plane as the side wall 18 of the enclosure 12, and so that the top wall 36 is aligned with and falls in the same horizontal plane as the roof 22 of the enclosure 12. An opening 44 in the rear wall 16 of the enclosure 12 places the duct 34 in gas flow communication with the furnace section 28 of the enclosure 12. For reasons to be described, a port 46 is provided for injecting a reactant into an upper portion of the duct 34 through the top wall 36 of the duct. The port 46 is located near the opening 44 in the rear wall 16 of the enclosure 12 and is also located closer to the inner wall 42 of the duct 34 than to the outer wall 40 thereof. Although the duct 34 depicted and described is subtantially rectangular, the duct 34 may have any number of shapes, including but not limited to a cylindrical configuration.

A cyclone separator 48 extends adjacent to the enclosure 12 and is connected thereto by the duct 34 which extends to an upper portion of the separator 48. An opening 49 in an outer wall of the separator 48 places the duct 34 in gas flow communication with the separator 48 so that flue gases and particulate materials may pass from the enclosure 12, through the duct 34, and into the separator 48. The lower portion of the separator 48 includes a conically shaped hopper section 50 which is connected at its lower end to a conduit 52 which has a branch conduit **52*a* extending back to the enclosure 12 and a branch conduit 52*b*** extending externally from the separator.

The separator 48 receives flue gases and entrained particulate materials from the furnace section 28 and operates in a conventional manner to disengage the entrained particulate materials from the flue gases. The separated particulate materials fall to the hopper section 50 of the separator 48 and pass to the conduit 52 for recycle to the furnace section 28, via the branch conduit **52*a*, or for disposal via the branch conduit 52*b*. Although reference is made to one separator 48, it is understood that one or more additional separators (not shown) may be used with the reactor 10. The number and size of separators 48** used is determined by the capacity of the steam generator and economic considerations.

The separated flue gases, which are substantially free of particulate materials, pass via a duct 54, located immediately above the separator 48, into a heat recovery section shown in general by the reference numeral 56. A plurality of heat exchange surfaces 58A, 58B, 58C are disposed in the heat recovery section 56, all of which are formed by a plurality of heat exchange tubes which extend in the path of the separated flue gases as the separated flue gases pass through the heat recovery section 56. The heat exchange surfaces 58A, 58B, 58C may serve as reheaters, superheaters, economizers, or the like, as desired. After passing across the heat exchange surfaces 58A, 58B, 58C, the separated flue gases exit the heat recovery section 56 through outlet 60.

The walls of the enclosure 12, the duct 34, the separator 48, and the heat recovery section 56 are preferably formed by a plurality of spaced, parallel tubes interconnected by fins to form contiguous airtight structures. Since this type of structure is conventional, it will not be shown or described in further detail. The ends of each of these finned tubes are connected to a plurality of horizontally disposed upper and lower headers (not shown), respectively.

A steam drum (not shown) is located above the enclosure 12, the duct 34, the separator 48, and the heat recovery section 56. The steam drum receives a cooling fluid such as water from a feed pipe, and a plurality of downcomers and pipes extend from the steam drum and are utilized, along with connecting feeders, risers, headers, etc., to establish a fluid flow circuit which includes the finned tubes forming the aforementioned walls and the heat exchange surfaces 58A, 58B, 58C in the heat recovery section 56. Water may be passed in a predetermined sequence through this fluid flow circuitry to convert the water to steam and to heat the steam with the heat generated by the combustion of the fuel particles.

In operation, particulate materials, including nitrogen-containing carbonaceous fuel particles, such as coal, and sorbent particles, typically a calcium-containing sulfur acceptor such as limestone, lime, or dolomite, are introduced into the furnace section 28 via the conduit 32 (FIG. 2). An oxygen-containing gas, such as air, from an external source is introduced at a relatively high pressure via the conduit 31 into the plenum chamber 30 and is passed upwardly through the distribution plate 26 at a relatively high fluidizing velocity to fluidize the particulate materials in the furnace section 28. A light-off burner 33 or the like ignites the fuel particles, and thereafter the fuel particles are self-combusted by the heat in the furnace section 28, thereby generating gaseous and solid products of combustion.

The velocity of the fluidizing gas is then controlled to maintain a dense bed of particulate materials in a lower portion of the furnace section 28 and to pass or entrain an amount of the particulate materials upwardly from the dense bed to form a dispersed bed above the dense bed.

The fluidizing gas mixes with the gaseous products of combustion to form flue gases which pass upwardly through the upper region of the furnace section 28 with the entrained particulate material. The flue gases and at least a portion of the entrained particulate materials pass from the furnace section 28, through the duct 34, and to the separator 48. In the separator 48, the particulate materials are separated from the flue gases and fall to the hopper section 50 of the separator 48 before passing to the conduit 52 for recycle to the furnace section 28, via branch conduit 52*a*, or for disposal via the branch conduit 52*b*.

The separated flue gases exit the separator 48 via the duct 54 and pass to a heat recovery section 56. In the heat recovery section 56, the separated flue gases pass through the heat exchange surfaces 58A, 58B, 58C before exiting via outlet 60.

Water is passed through the feed pipe to the steam drum and is then passed through the fluid flow circuit so that the heat generated by combustion is used to convert the water to steam and to superheat the steam.

As the flue gases, with the entrained particulate materials, pass from the furnace section 28, through the opening 44, and into the duct 34, the particulate materials tend to move toward an upper, outer portion of the duct 34, whereas the flue gases, including undesired $NO_x$, tend to be concentrated more toward an upper, inner portion of the duct. Due to this action, a gaseous-rich region is formed in the upper, inner portion of the duct.

A reactant for lowering $NO_x$ levels, such as ammonia or urea, is selectively injected into the gaseous-rich region of the duct. The reactant is typically chosen for its ability to provide an $NH_2$ radical which, through a series of complex reactions, reacts with the $NO_x$ to yield $N_2$ and $H_2O$. The reactant is injected into the gaseous-rich region of the duct 34, in an upper portion of the duct nearer to the inner wall 42 of the duct 34 than to the outer wall 40 of the duct 34, to provide a high degree of mixing of the reactant with the flue gases, including $NO_x$, while avoiding a high degree of mixing of the reactant with the particulate materials in the upper, outer portion of the duct 34. The point of injection of the reactant into the duct 34 is also at a location near the opening 44 to provide for increased residence time of the reactant. The high degree of mixing of the reactant with the flue gases, the low degree of mixing of the reactant with the particulate materials, and the high residence time of the reactant in the system allow for efficient use of the reactant while obtaining a large decrease in $NO_x$ levels in the flue gases.

Several advantages result from the foregoing system and method. For example, emissions of $NO_x$ are lowered while making efficient use of expensive reactants. Also, problems associated with excessive reactant use are also avoided. The selective injection of the reactant is also advantageous from the standpoint of ease and cost of fabrication and operation.

It is understood that variations may be made in the system and method of the present invention without departing from the scope of the present invention. For example, the injection point of the reactant may be in any number of locations along the duct 34, as long as the reactant is injected into a gaseous-rich region of the duct 34 near an upper, inner portion of the duct 34. In that regard, the injection port 46 may pass through the upper 36, lower 38, outer 40, or inner 42, walls of the duct 34 and may extend into the duct 34 or terminate in a duct wall. Although it is preferred that the duct 34 be formed by finned, cooling tubes, the duct 34 may be of any conventional construction. Additionally, the separator 48 may, but need not, be a cyclone separator and one or more separators may be associated with the furnace section. Although only a single source of fluidizing gas is discussed in the detailed description, it is understood that the method and system of the present invention may be used in connection with multi-staged combustion in which fluidizing and combustive gases may be introduced into the furnace section at various locations and at various levels.

Other modifications, changes, and substitutions are intended in the foregoing disclosure and, in some instances, some features of the invention can be employed without a corresponding use of other features. Various modifications to the disclosed embodiment as well as alternative applications of the invention will be suggested to persons skilled in the art by the foregoing specification and drawing. Accordingly, it is appropriate that the appended claims be construed broadly and in a manner consistent with the scope of the invention therein.

What is claimed is:

1. A combustion system for decreasing $NO_x$ emissions, comprising:

an enclosure for receiving nitrogen-containing fuel, said enclosure including a first wall having an opening formed in an upper portion thereof;

means for combusting said nitrogen-containing fuel in said enclosure, thereby producing flue gases;

a duct connected at one end to said opening in gas flow communication with said enclosure, said duct having a top wall, a first side wall, and a second side wall; and means for injecting a reactant through said top wall of said duct for decreasing $NO_x$ levels in flue gases passing from said enclosure and through said duct, said means for injecting a reactant being disposed to inject said reactant nearer to said one end of said duct than to the other end thereof, and nearer to said first side wall of said duct than to said second side wall of said duct.

2. The system of claim 1 further comprising a separator, said other end of said duct being connected to said separator so that said enclosure, said duct, and said separator are in gas flow communication.

3. The system of claim 2 wherein said separator is a cyclone separator.

4. The system of claim 1 wherein said enclosure first wall defines first and second substantially vertical edges and said opening is formed nearer to said first edge than to said second edge.

5. The system of claim 4 wherein said duct second side wall is nearer than said duct first side wall to said first edge.

6. The system of claim 1 wherein said enclosure further includes a second wall adjacent to said enclosure first wall and said duct second side wall forms a substantial extension of said enclosure second wall.

7. A combustion system for decreasing $NO_x$ emissions, said system comprising:

an enclosure for receiving particulate materials including a nitrogen-containing particulate fuel material;

means for combusting said particulate fuel material in said enclosure;

a duct connected at one end to an upper portion of said enclosure in gas flow communication with said enclosure, said duct having first and second side walls;

means disposed in a lower portion of said enclosure for introducing an oxygen-containing, fluidizing gas into said enclosure to support combustion of said particulate fuel materials and to fluidize said particulate materials so that said fluidizing gas combines with gaseous products of combustion to form flue gases and so that said flue gases entrain said particulate materials and said flue gases and said entrained particulate materials pass upwardly through said enclosure and through said duct, said duct being disposed relative to said enclosure so that said flue gases tend to pass through a first portion of said duct adjacent to said first side wall of said duct and said particulate materials tend to pass through a second portion of said duct adjacent to said second side wall of said duct; and means disposed relative to said duct for selectively injecting a reactant into said first portion of said duct for decreasing $NO_x$ levels in said flue gases passing through said duct, while making efficient usage of said reactant.

8. The system of claim 7 wherein said flue gases tend to pass through an upper portion of said first portion of said duct, and wherein said injecting means injects said reactant into said upper portion of said first portion of said duct.

9. The system of claim 8 wherein said means for selectively injecting said reactant comprises an injector passing through said upper portion of said duct.

10. The system of claim 9 wherein said injector passes through said upper portion of said duct nearer to said one end of said duct than to the other end thereof.

11. The system of claim 10 wherein said injector passes through said upper portion of said duct nearer to said first side wall of said duct than to said second side wall of said duct.

* * * * *

UNITED STATES PATENT AND TRADEMARK OFFICE

CERTIFICATE OF CORRECTION

PATENT NO. : 5,462,718

DATED : October 31, 1995

INVENTOR(S) : Iqbal F. Abdulally

It is certified that error appears in the above-indentified patent and that said Letters Patent is hereby corrected as shown below:

On title page, item [75]

The inventor's name should be: --Iqbal F. Abdulally--

Signed and Sealed this

Twenty-seventh Day of February, 1996

*Attest:*

Bruce Lehman

BRUCE LEHMAN

*Attesting Officer*

*Commissioner of Patents and Trademarks*